US009124019B1

(12) United States Patent
Liang

(10) Patent No.: US 9,124,019 B1
(45) Date of Patent: Sep. 1, 2015

(54) ADAPTER WITH RETRACTABLE PINS

(71) Applicant: Phihong Technology Co., Ltd, Taoyuan County (TW)

(72) Inventor: Chien-Hua Liang, Taoyuan County (TW)

(73) Assignee: PHIHONG TECHNOLOGY CO., LTD, Taoyuan County (TW)

( * ) Notice: Subject to any disclaimer, the term of this patent is extended or adjusted under 35 U.S.C. 154(b) by 14 days.

(21) Appl. No.: 14/242,097

(22) Filed: Apr. 1, 2014

(30) Foreign Application Priority Data

Feb. 7, 2014 (JP) ..... 2014-022016

(51) Int. Cl.
*H01R 13/44* (2006.01)
*H01R 13/502* (2006.01)

(52) U.S. Cl.
CPC ..... *H01R 13/44* (2013.01); *H01R 13/502* (2013.01)

(58) Field of Classification Search
CPC ..... H01R 35/04; H01R 13/60
USPC ..... 439/131, 528
See application file for complete search history.

(56) References Cited

U.S. PATENT DOCUMENTS

| | | | | |
|---|---|---|---|---|
| 5,967,807 | A * | 10/1999 | Wu | 439/131 |
| 6,042,400 | A * | 3/2000 | Queffelec et al. | 439/131 |
| 7,354,286 | B1 * | 4/2008 | Lee | 439/172 |
| 7,549,877 | B1 * | 6/2009 | Vista et al. | 439/172 |
| 9,011,165 | B2 * | 4/2015 | Liu et al. | 439/131 |
| 2010/0291779 | A1 * | 11/2010 | Hopwood et al. | 439/131 |

* cited by examiner

*Primary Examiner* — Abdullah Riyami
*Assistant Examiner* — Thang Nguyen
(74) *Attorney, Agent, or Firm* — Muncy, Geissler, Olds & Lowe, P.C.

(57) ABSTRACT

The present invention provides an adapter with retractable pins, which can be retracted to be hided to save space, and can be adjusted to different angles to be adjusted to different angles to be suitable for different conditions.

12 Claims, 4 Drawing Sheets

ADAPTER WITH RETRACTABLE PINS

FIELD OF THE INVENTION

The present invention relates to an adapter and more particularly to an adapter with retractable pins.

DESCRIPTION OF THE PRIOR ART

Consumer electronic products including notebooks, personal digital assistants (PDA), mobile phones, MP3 players, and so on, are trending toward smaller sizes continuously. Therefore, the adapters of consumer electronic products are required to be made with smaller sizes and less weight, and more convenient for shipment.

However, many conventional adapters merely provide fixed pins, which cannot be retracted to be hided to save space, and cannot be adjusted to different angles to be suitable for different conditions. Further, the pins of the conventional adapters could be damaged by collisions and the damaged pins could result in the blaze when the adapters are put aside since their pins are not retractable to be hided.

Various kinds of adapters come out recently for the consumer electronic products to be carried conveniently. However, there is still a demand for adapters to overcome the above shortcomings.

SUMMARY OF THE INVENTION

In view of the aforementioned defects of the conventional adapters, the present invention discloses an adapter with a flexible mechanism.

The present invention provides an adapter with retractable pins, which can be retracted to be hided to save space, and can be adjusted to different angles to be adjusted to different angles to be suitable for different conditions. Further, the pins of the present invention will not be damaged by collisions and thus the present invention can prevent the blaze resulted from the damaged pins when the adapters are put aside since their pins are retractable to be hided.

The present invention provides an adapter with retractable pins, comprising: a rack including the retractable pins, base ends, and a linking rod for linking the base ends; a lower case including pin receiving slots with through holes formed therein wherein the retractable pins of the rack are inserted into the through holes and the pin receiving slots are shaped to contain the retractable pins of the rack; an inner case on which springs are mounted wherein the springs are used to apply elasticity on the base ends of the rack to fix positions of the retractable pins of the rack temporarily; and an upper case containing the inner case and engaged with the lower case, wherein the base ends of the rack include extended parts, which contact the springs.

Alternatively, the adapter of the present invention further comprises a holder mounted on the upper case with a groove formed therein to hold the linking rod of the rack.

Alternatively, the upper case further comprises rack bases with notches formed therein to hold the base ends of the rack, the inner case further comprises a square notch to contain the rack and the holder.

Alternatively, the pin receiving slots of the lower case extend to an U-shaped protrusion, and the upper case further comprises an U-shaped notch to contain the U-shaped protrusion.

Alternatively, the lower case further comprises a first concave surface to allow a finger tip, and the first concave surface is semicircular, wherein the first concave surface is inside a second concave surface, wherein the second concave surface is square.

Alternatively, the second concave surface is connected to the pin receiving slots.

BRIEF DESCRIPTION OF THE DRAWINGS

The primitive objectives and advantages of the present invention will become apparent upon reading the following description and upon reference to the accompanying drawings in which.

DESCRIPTION OF THE PREFERRED EMBODIMENT

In order to fully understand the manner in which the above-recited details and other advantages and objects according to the invention are obtained, a more detailed description of the invention will be rendered by reference to the best-contemplated mode and specific embodiments thereof. The following description of the invention is made for the purpose of illustrating the general principles of the invention and should not be taken in a limiting sense; it is intended to illustrate various embodiments of the invention. As such, the specific modifications discussed are not to be construed as limitations on the scope of the invention. It will be apparent to one skilled in the art that various equivalents, changes, and modifications may be made without departing from the scope of the invention, and it is understood that such equivalent embodiments are to be included herein. The terminology used in the description presented below is intended to be interpreted in its broadest reasonable manner, even though it is being used in conjunction with a detailed description of certain specific embodiments of the invention. Certain terms may even be emphasized below; however, any terminology intended to be interpreted in any restricted manner will be overtly and specifically defined as such in this detailed description section. Where the context permits, singular or plural terms may also include the plural or singular term, respectively. Moreover, unless the word "or" is expressly limited to mean only a single item exclusive from the other items in a list of two or more items, then the use of "or" in such a list is to be interpreted as including (a) any single item in the list, (b) all of the items in the list, or (c) any combination of items in the list.

Preferred embodiments and aspects of the invention will be described to explain the scope, structures and procedures of the invention. In addition to the preferred embodiments of the specification, the present invention can be widely applied in other embodiments.

Figure 1:
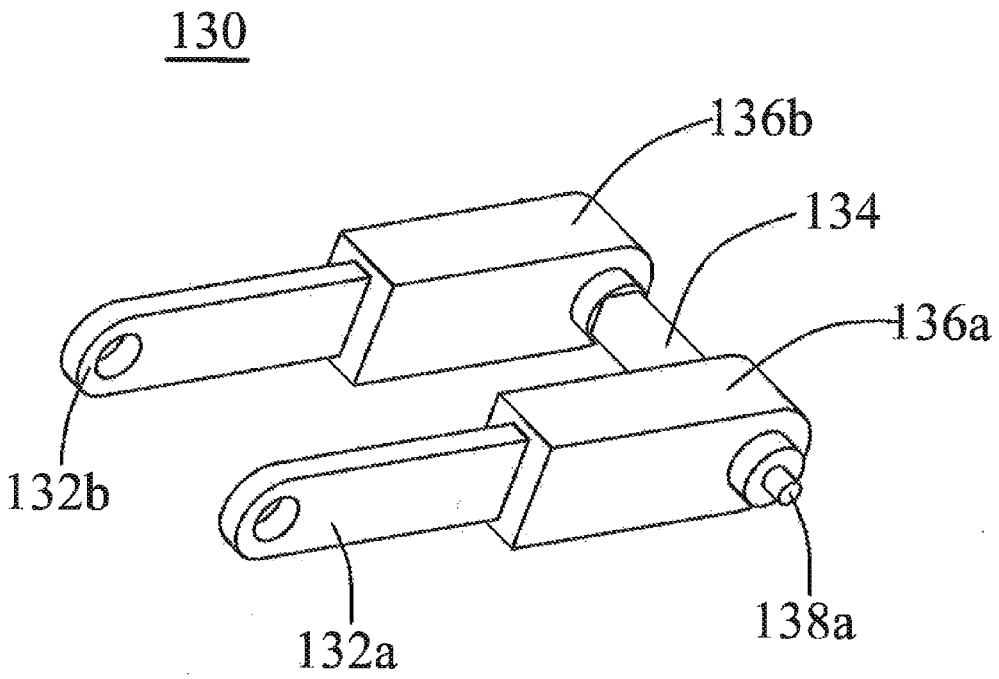
FIG. 1 is a perspective view of a rack with retractable pins according to the present invention.

The present invention provides an adapter (100) with retractable pins (132*a*, 132*b*). FIG. 1 shows a perspective view of a rack (130) with retractable pins (132*a*, 132*b*) according to the present invention. The rack (130) may include the retractable pins (132*a*, 132*b*), base ends (136*a*, 136*b*), and a linking rod (134) for linking the base ends (136*a*, 136*b*).

Figure 2A:
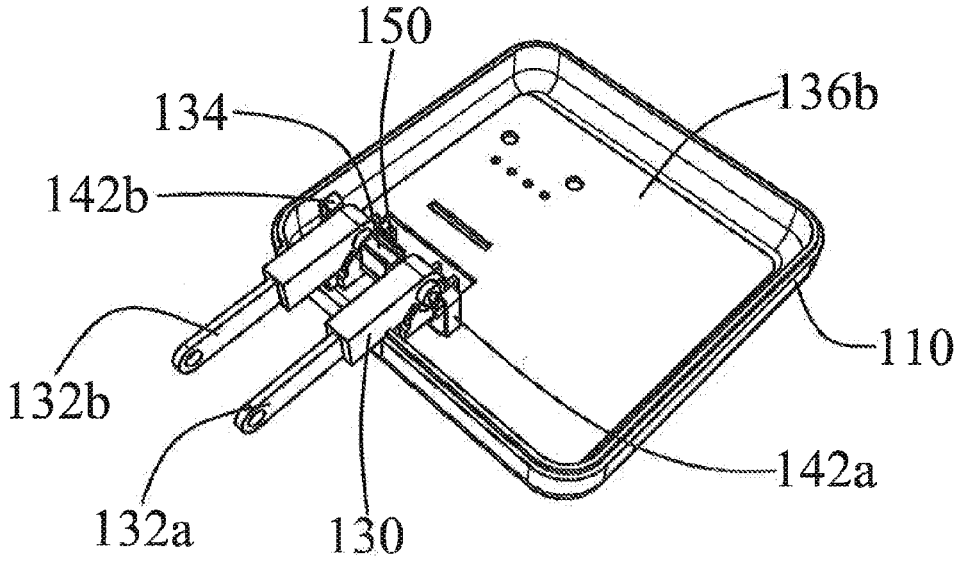
FIG. 2A is a perspective view of an upper case of the adapter containing the rack and the holder according to the present invention.
Figure 2B:
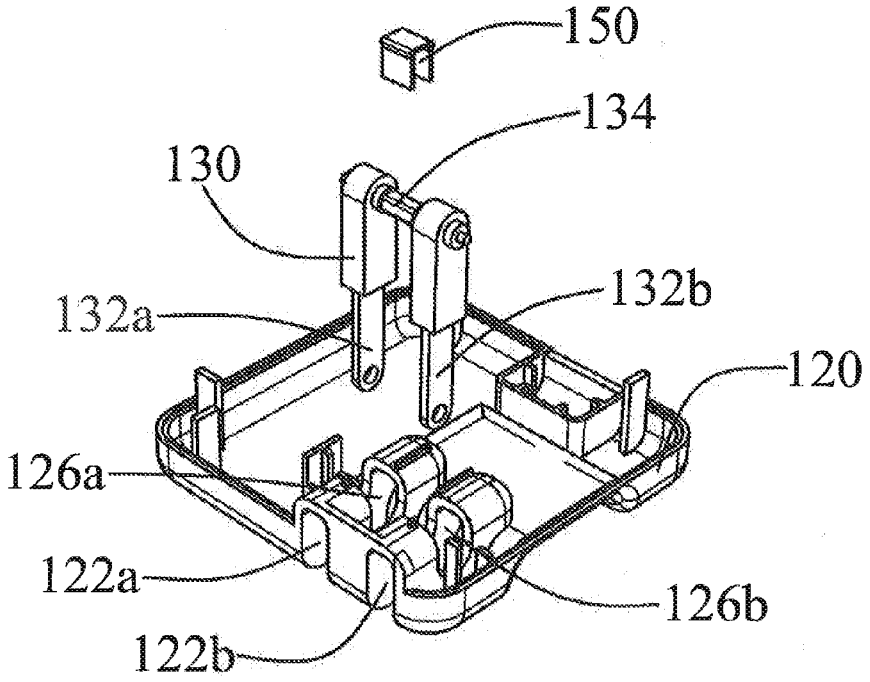
FIG. 2B is a perspective view of a lower case of the adapter showing the way that the retractable pins are inserted through the lower case according to the present invention.

FIG. 2B shows a perspective view of a lower case (120) of the adapter showing the way that the retractable pins (132*a*, 132*b*) are inserted through the lower case (120) according to the present invention. The lower case (120) may include pin receiving slots (122*a*, 122*b*) with through holes (126*a*, 126*b*) formed therein wherein the retractable pins (132*a*, 132*b*) of the rack (130) are inserted into the through holes (126*a*, 126*b*) and the pin receiving slots (122*a*, 122*b*) are shaped to contain the retractable pins (132*a*, 132*b*) of the rack (130).

FIG. 2A shows a perspective view of an upper case (110) of the adapter containing the rack (130) and the holder (150) according to the present invention. An inner case (140) on which springs (142*a*, 142*b*) are mounted wherein the springs (142*a*, 142*b*) are used to apply elasticity on the base ends (136*a*, 136*b*) of the rack (130) to fix positions of the retractable pins (132*a*, 132*b*) of the rack (130) temporarily. And, an upper case (110) containing the inner case (140) and engaged with the lower case (120). Alternatively, the base ends (136*a*, 136*b*) of the rack (130) can include extended parts (138*a*, 138*b*), which contact the springs (142*a*, 142*b*)

Further, a holder (150) is mounted on the upper case (110) with a groove formed therein to hold the linking rod (134) of the rack (130).

Figure 3:
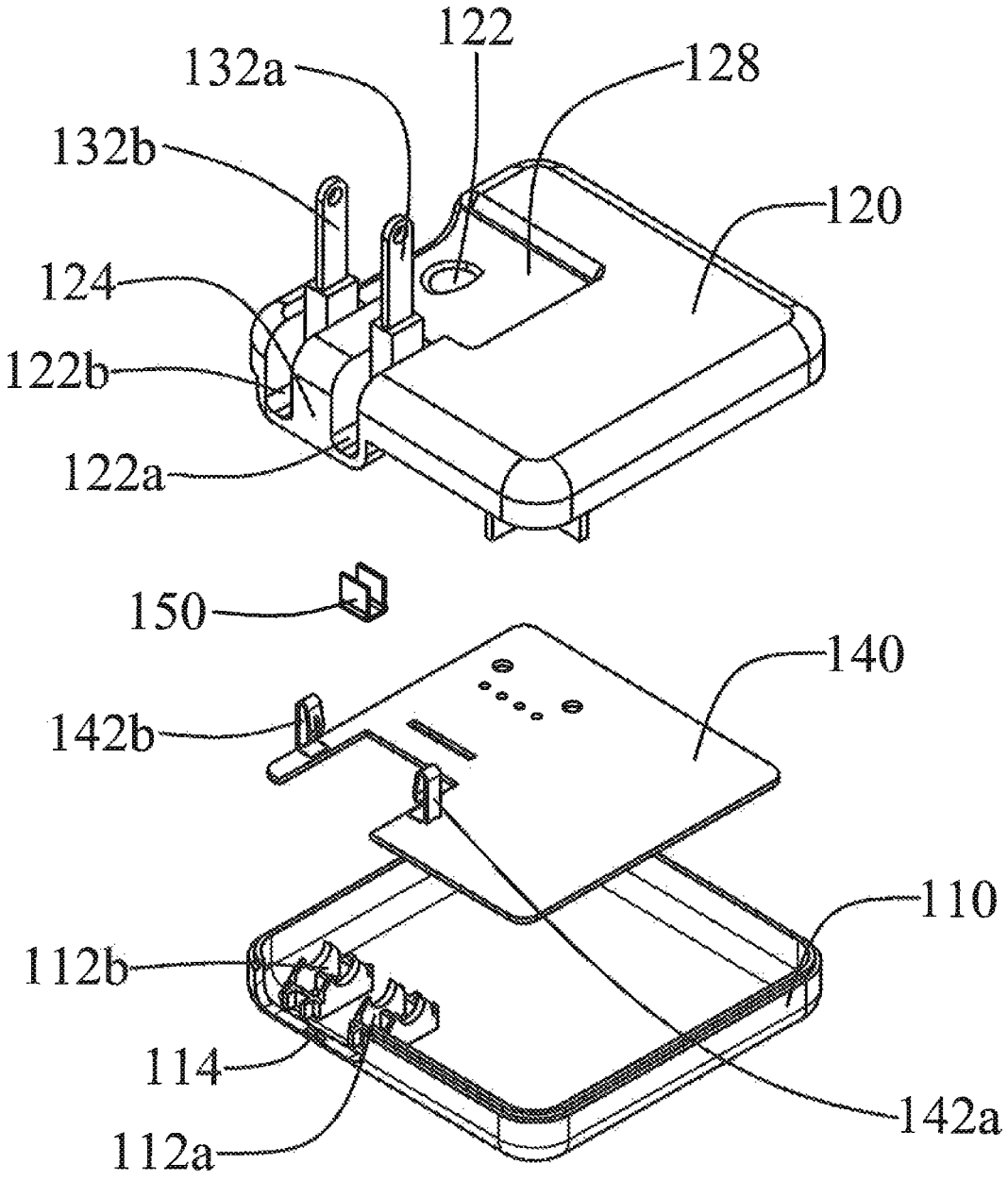
FIG. 3 is an exploded view of the adapter according to the present invention.

FIG. 3 is an exploded view of the adapter (100) according to the present invention. The upper case (110) may further comprise rack bases (112*a*, 112*b*) with notches formed therein to hold the base ends (136*a*, 136*b*) of the rack (130).

Further, the inner case (140) may further comprise a square notch to contain the rack (130) and the holder (150).

The pin receiving slots (122*a*, 122*b*) of the lower case (120) may extend to an U-shaped protrusion (124), and the upper case (110) may further comprise an U-shaped notch (114) to contain the U-shaped protrusion (124).

Alternatively, the lower case (120) may further comprise a first concave surface (122) to allow a finger tip of a user. And, the first concave surface (122) may be semicircular, and may be inside a second concave surface (128). Further, the second concave surface (128) is square, and connected to the pin receiving slots (122*a*, 122*b*).

Figure 4A:
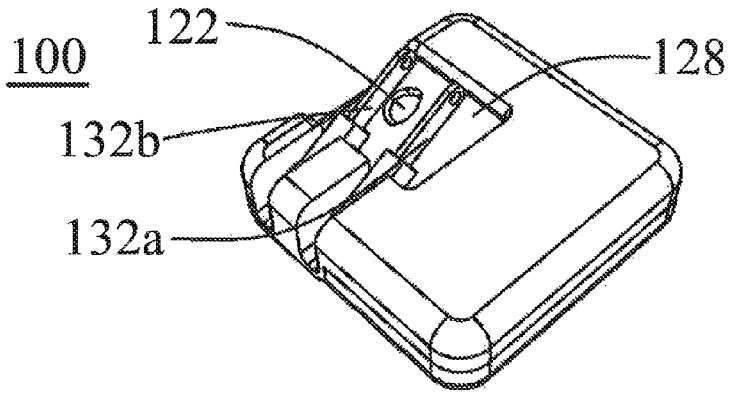
FIGS. 4A-4C illustrate the possible angles of the retractable pins according to the present invention.
Figure 4B:
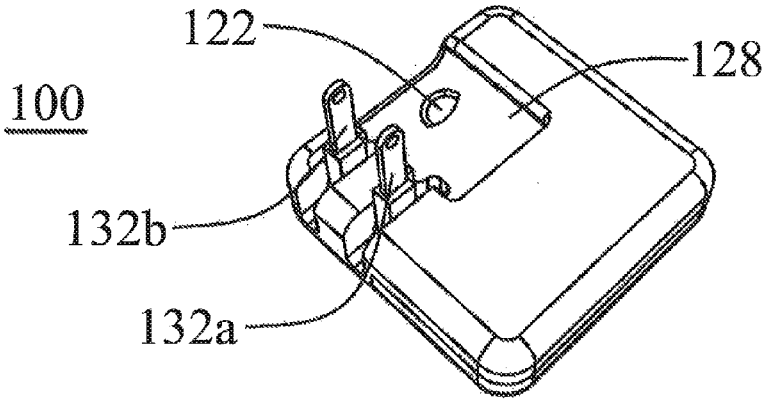
Figure 4C:
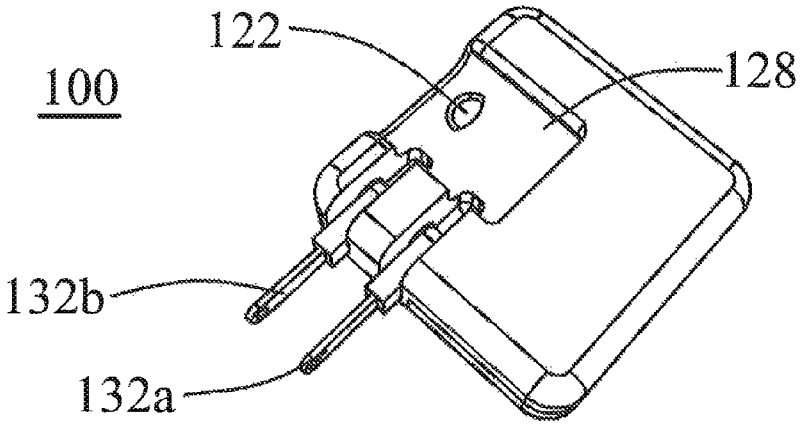

FIGS. 4A-4C illustrate the possible angles of the retractable pins according to the present invention. Because the springs (142*a*, 142*b*) inside the adapter (100) apply elasticity on the base ends (136*a*, 136*b*) of the rack (130), the positions of the retractable pins (132*a*, 132*b*) of the rack (130) can be fixed temporarily, and thus the retractable pins (132*a*, 132*b*) of the rack (130) can be in multiple positions (angles). FIG. 4A shows that the retractable pins (132*a*, 132*b*) of the rack (130) are in the hidden position, FIG. 4B shows that the retractable pins (132*a*, 132*b*) of the rack (130) are in the top position, and FIG. 4C shows that the retractable pins (132*a*, 132*b*) of the rack (130) are in the side position.

The foregoing description, for purposes of explanation, was set forth in specific details of the preferred embodiments to provide a thorough understanding of the invention. However, it will be apparent to one skilled in the art that specific details are not required in order to practice the invention. Therefore, the foregoing descriptions of specific embodiments of the invention are presented for purposes of illustration and description only and should not be construed in any way to limit the scope of the invention. They are not intended to be exhaustive or to limit the invention to the precise forms disclosed; obviously, many modifications and variations are possible in view of the above teachings. The embodiments were chosen and described in order to best explain the principles of the invention and its practical applications, thereby enabling others skilled in the art to best utilize the invention and various embodiments with various modifications as are suited to the particular use contemplated. It is intended that the following Claims and their equivalents define the scope of the invention.

The above-described embodiments of the present invention are intended to be illustrative only. Numerous alternative embodiments may be devised by those skilled in the art without departing from the scope of the following claims.

What is claimed is:

1. An adapter (100) with retractable pins (132*a*, 132*b*), comprising:

a rack (130) including the retractable pins (132*a*, 132*b*), base ends (136*a*, 136*b*), and a linking rod (134) for linking the base ends (136*a*, 136*b*);

a lower case (120) including pin receiving slots (122*a*, 122*b*) with through holes (126*a*, 126*b*) formed therein wherein the retractable pins (132*a*, 132*b*) of the rack (130) are inserted into the through holes (126*a*, 126*b*) and the pin receiving slots (122*a*, 122*b*) are shaped to contain the retractable pins (132*a*, 132*b*) of the rack (130);

an inner case (140) on which springs (142*a*, 142*b*) are mounted wherein the springs (142*a*, 142*b*) are used to apply elasticity on the base ends (136*a*, 136*b*) of the rack (130) to fix positions of the retractable pins (132*a*, 132*b*) of the rack (130) temporarily; and an upper case (110) containing the inner case (140) and engaged with the lower case (120).

2. The adapter of claim 1, further comprises a holder (150) mounted on the upper case (110) with a groove formed therein to hold the linking rod (134) of the rack (130).

3. The adapter of claim 1, wherein the upper case (110) further comprises rack bases (112*a*, 112*b*) with notches formed therein to hold the base ends (136*a*, 136*b*) of the rack (130).

4. The adapter of claim 1, wherein the inner case (140) further comprises a square notch to contain the rack (130) and the holder (150).

5. The adapter of claim 1, wherein the pin receiving slots (122*a*, 122*b*) of the lower case (120) extend to an U-shaped protrusion (124).

6. The adapter of claim 5, wherein the upper case (110) further comprises an U-shaped notch (114) to contain the U-shaped protrusion (124).

7. The adapter of claim 1, wherein the lower case (120) further comprises a first concave surface (122) to allow a finger tip.

8. The adapter of claim 7, wherein the first concave surface (122) is semicircular.

9. The adapter of claim 7, wherein the first concave surface (122) is inside a second concave surface (128).

10. The adapter of claim 8, wherein the second concave surface (128) is square.

11. The adapter of claim 8, wherein the second concave surface (128) is connected to the pin receiving slots (122*a*, 122*b*).

12. The adapter of claim 1, wherein the base ends (136*a*, 136*b*) of the rack (130) include extended parts (138*a*, 138*b*), which contact the springs (142*a*, 142*b*).

* * * * *